United States Patent [19]

Kawamoto

[11] 3,979,991

[45] Sept. 14, 1976

[54] ELECTRONIC EXPRESSION DEVICE FOR PRODUCING TREMULANT EFFECT

[75] Inventor: Kinji Kawamoto, Neyagawa, Japan

[73] Assignee: Matsushita Electric Industrial Co., Ltd., Osaka, Japan

[22] Filed: Aug. 17, 1973

[21] Appl. No.: 389,203

Related U.S. Application Data

[63] Continuation of Ser. No. 245,083, April 18, 1972, abandoned, which is a continuation of Ser. No. 826,190, May 20, 1969, abandoned.

[30] Foreign Application Priority Data

| | | |
|---|---|---|
| May 22, 1968 | Japan | 43-35253 |
| May 23, 1968 | Japan | 43-35352 |
| May 23, 1968 | Japan | 43-35353 |
| May 23, 1968 | Japan | 43-35354 |
| June 19, 1968 | Japan | 43-43040 |
| June 19, 1968 | Japan | 43-43042 |
| June 19, 1968 | Japan | 43-43043 |
| June 25, 1968 | Japan | 43-44724 |
| Aug. 8, 1968 | Japan | 43-56908 |
| Oct. 21, 1968 | Japan | 43-77562 |

[52] U.S. Cl. ..... 84/1.25

[51] Int. Cl.[2] ..... G10H 1/02

[58] Field of Search ..... 84/1.01, 1.24, 1.25, 84/DIG. 4

[56] References Cited

UNITED STATES PATENTS

| | | | |
|---|---|---|---|
| 3,004,460 | 10/1961 | Wayne | 84/1.01 |
| 3,007,361 | 11/1961 | Wayne | 84/1.01 |
| 3,418,418 | 12/1968 | Wilder | 84/1.25 |
| 3,516,318 | 6/1970 | Wayne | 84/1.01 |
| 3,524,376 | 8/1970 | Heytow | 84/1.25 |

*Primary Examiner*—L. T. Hix
*Assistant Examiner*—Stanley J. Witkowski
*Attorney, Agent, or Firm*—Wenderoth, Lind & Ponack

[57] ABSTRACT

An electronic expression device for producing a tremulant effect. The device has a distributor having one input terminal and a plurality of output terminals, a plurality of transmission channels being connected to the respective output terminals of the distributor, and a coupler for coupling the output signals of the channels. At least one of the channels has a modulator having a characteristic such that at least either the modulation depth or the modulation frequency increases in accordance with an increase in the frequency of the input signal and the modulation depth exceeds $\pm \pi/2$ radian for phase modulation and 100% for amplitude modulation in a high frequency range. The distributor can be such as to produce different phase shifting characteristics in the signals at the respective output terminals and the channels can have different phase shifting characteristics from each other for securing a further novel tremulant effect. The audio frequency signal applied to the input terminal of the distributor is translated in such a manner that vectors of the signal are fluctuating differently in frequency, phase and amplitude.

8 Claims, 31 Drawing Figures

FIG.1
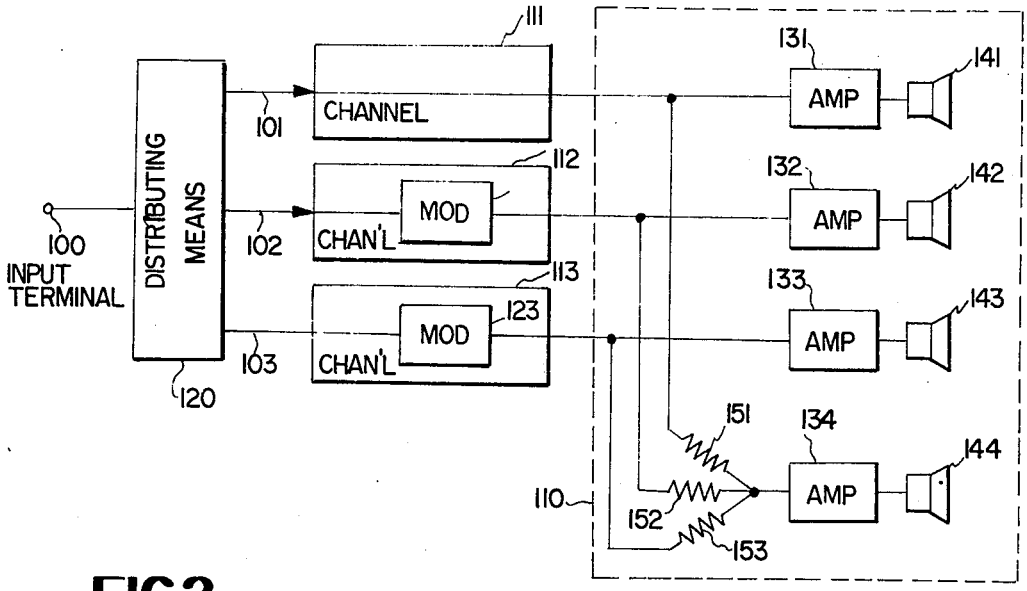
FIG.2
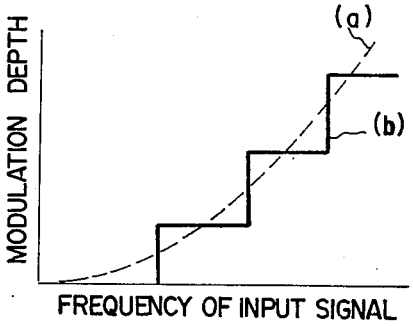
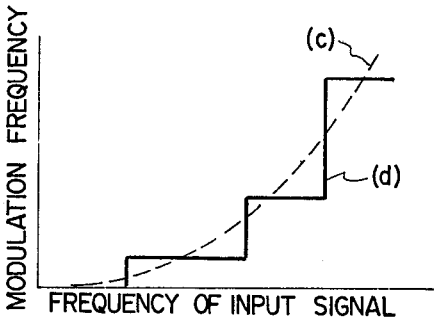
FIG.3
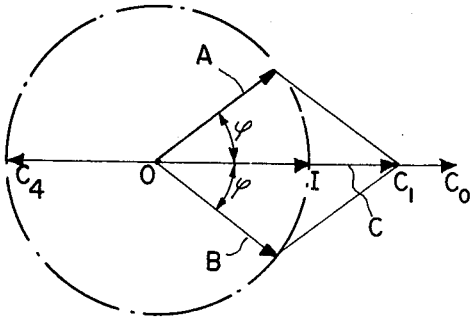
FIG.5
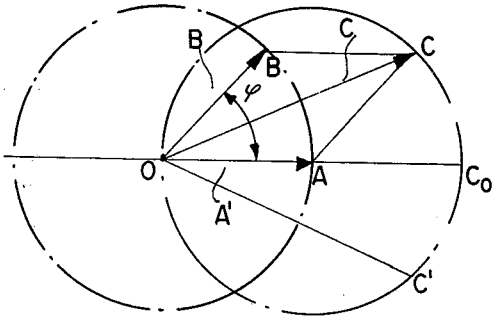
FIG.8
INVENTOR
KINJI KAWAMOTO
BY Wenderoth, Lind & Ponack
ATTORNEYS

INVENTOR
KINJI KAWAMOTO

BY Wenderoth, Lind & Ponack
ATTORNEYS

INVENTOR
KINJI KAWAMOTO

BY Wenderoth, Lind & Ponack
ATTORNEYS

INVENTOR
KINJI KAWAMOTO

BY Wenderoth, Lind & Ponack
ATTORNEYS

INVENTOR
KINJI KAWAMOTO

BY Wenderoth, Lind & Ponack
ATTORNEYS

INVENTOR
KINJI KAWAMOTO

BY Wenderoth, Lind & Ponack

ATTORNEYS

ELECTRONIC EXPRESSION DEVICE FOR PRODUCING TREMULANT EFFECT

This application is a continuation of application Ser. No. 245,083 filed Apr. 18, 1972, and now abandoned, which is a continuation of application Ser. No. 826,190 filed May 20, 1969, and now abandoned.

FIELD OF INVENTION

The present invention relates to an electronic expression device for achieving a tremulant effect and a chorus effect by processing an audio frequency signal, and more particularly relates to an electronic expression device which is capable of translating each of the vectors of the audio frequency signal so that they vary in frequency, phase and amplitude.

DESCRIPTION OF THE PRIOR ART

A conventional tremulant effect in a pipe organ is achieved by fluctuating the pressure of the air and producing the amplitude and the frequency fluctuation. A conventional celeste effect or an ensemble effect in a pipe organ is achieved by providing for beats between pipes which are purposely detuned slightly with respect to one another. A conventional vibrato effect in an electronic organ is achieved by frequency modulation. A conventional tremolo effect in an electronic organ is achieved by amplitude modulation.

The above-mentioned effects are due to the fluctuation of the vectors of the audio frequency signal. The vibrato effect is due to angular fluctuations of constant amplitude vectors. The tremolo is due to amplitude fluctuations of constant angle vectors. The tremulant effect of a pipe organ is similar to a beat effect and is due to amplitude fluctuations and angular fluctuations of the vectors. The celeste effect or the ensemble effect of a pipe organ is the beat effect which is explained by the fluctuations of the vectors having the ends moving on a circular locus.

The following description explains the reasons why the above-mentioned effects of the pipe organ are superior to the conventional vibrato and tremolo effects of the electronic organ.

The first reason is the tonal quality. The beat effect of a pipe organ has a better tonal quality with respect to both strength and clearness than the tone of an electronic organ produced by frequency or phase modulation corresponding to the angular fluctuation of the vector and amplitude modulation corresponding to a change of amplitude of the vector.

The second reason is the difference in the complexity of the effect. The fundamental beat frequencies between the tuned pipes and the slightly detuned pipes are respectively different from each other due to the different pitches of the tuned pipes. The beat frequencies between harmonics of the tuned pipes and the detuned pipes are also different from each other, respectively, according to the order of the harmonics. That is, when several pipes sound together, the beat frequencies of the pipes are numerous and their relation is very complex so the chorus or the ensemble effect is completely achieved. Contrary to the celeste effect or the ensemble effect of a pipe organ, the vibrato effect and the tremolo effect of an electronic musical instrument are monotonous because usually only one vibrato frequency and tremolo frequency are used.

The third is in the spatial distribution and the spread effects of sounds. The pipe organ has many pipes arranged in the pipe room and the sound of each pipe is heard from a different direction. A conventional technique to get a spread of the sounds in an electronic organ is to use a multi modulator and reproducer system as described in U.S. Pat. No. 3,083,606 patented Apr. 2, 1963 to Don L. Bonham.

Even if said multi modulator and reproducer system is used, however, lack of the complex beat effect and the defect of the monotonous impression are not overcome.

Another conventional technique to improve the abovementioned defects and to get a spread of sounds is to use a rotating loud speaker as described in U.S. Pat. No. 2,489,653 patented Nov. 29, 1949 to Donald J. Leslie.

But the mechanical rotating speaker construction has many defects, for example, difficulty in starting and stopping instantly, difficulty in controlling the rotating speed, difficulty in changing the depth of modulation, necessity of maintenance and generation of rotating noises.

SUMMARY OF THE INVENTION

It is a primary object of the present invention to provide an electronic expression device for producing a tremulant effect which improves a vibrato and a tremelo effect used widely in music by complicating the motions of the frequency vectors of an audio frequency signal and by reducing the impression of a monotonous fluctuation.

It is another object of the invention to provide an electronic expression device characterized by a tremulant effect in which at least either the magnitude or the frequency of fluctuation of the vectors of the audio frequency signal increases with an increase in the frequency of the audio frequency signal so that simultaneous fluctuation decreases.

A further object of the present invention is to provide an electronic expression device characterized by a tremulant effect in which the magnitude and the frequency of the fluctuation of the vectors of the audio frequency signal is small in the low frequency range and large in the high frequency range.

A further object of the present invention is to provide a method for adding a tremulant effect which gives only a slight impression of a simultaneous fluctuation to signals of an electronic and electric musical instrument, a conventional musical instrument, a recorded disc, a recorded tape, a human voice and so on.

A further object of the present invention is to provide a method for producing a new fluctuation effect which is different from the conventional vibrato and tremolo effects by use of a system comprising a plurality of channels at least one of which has modulation means as a part thereof.

A further object of the present invention is to provide a tremulant effect having a spatial distribution and a spread of sounds.

A further object of the present invention is to provide a beat-like fluctuation of a tone having more strength and clearness of tonal quality than the conventional vibrato and tremolo effects.

A further object of the present invention is to provide a tremulant effect which does not give the impression of a simultaneous fluctuation by using a delay line, a phase shifter or a phase splitter, the split phase of which increases in accordance with an increase in the frequency of the input signal.

A further object of the present invention is to provide a method for electronically producing a tremulant effect and further to provide an easy way to control the depth and speed of the fluctuations.

A further object of the present invention is to provide a novel tremulant effect by converting an audio frequency signal into a plurality of signals at least one of which is deeply modulated, that is, the phase modulation depth is more than $+\pi/4$ radians and preferably more than $\pm \pi/2$ radians, and the amplitude modulation ratio exceeds 100%, especially in the high frequency range.

These objectives are achieved by employing an electronic expression device for producing a tremulant effect according to the present invention comprising a plurality of transmission channels, means for distributing an audio frequency signal to said channels, means for connecting said distributing means with said transmission channels, and means for coupling the output signals of said transmission channels, at least one of said channels having modulation means as a part thereof, said modulation means modulating each of the distributed audio frequency signals so that it is different in phase from the others in the sub-audio frequency range. Said modulation means modulates the input signal to said modulation means in such a manner that at least either the modulation depth or the modulation frequency increases with an increase in the frequency of the audio frequency signal, and the modulation means deeply modulates said input signal in the high frequency range.

BRIEF DESCRIPTION OF THE DRAWINGS

These and other objects and particulars of the present invention will be made clear from the following detailed description of the invention considered together with the accompanying drawings, wherein:

FIG. 1 is a schematic block diagram of an embodiment of an electronic expression device for producing a tremulant effect according to the present invention;

FIG. 2 is a diagram of the modulation depth vs. the input frequency characteristics of the modulators;

FIG. 3 is a diagram of the modulation frequency vs. the input frequency characteristic of the modulators;

FIG. 5 is a vector diagram explaining the operation of the device of FIG. 4;

FIG. 8 is a vector diagram explaining the operation of the device of FIG. 7;

DETAILED DESCRIPTION

Figure 4:
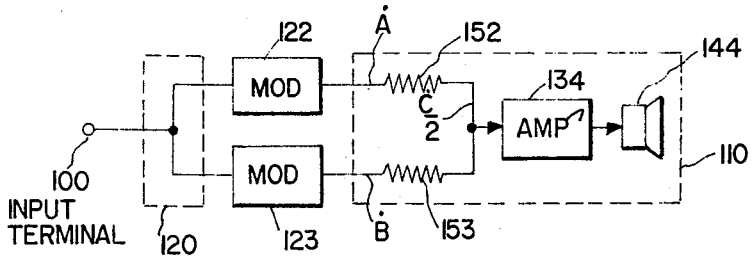
FIG. 4 is a schematic block diagram of a second embodiment of the device of the present invention.

Referring to FIG. 1, an audio frequency signal applied to an input terminal 100 is delayed or has its phase shifted by a distributing means 120 and is fed to transmission channels 111, 112 and 113 through connecting means 101, 102 and 103, respectively. The distributing means 120 is a circuit for feeding the audio frequency signal at the input terminal 100 to some of the transmission channels 111, 112 and 113 without any alteration in wave shape. At least one of the transmission channels 111, 112 and 113, for example the transmission channels 112 and 113, have modulation means 122 and 123 as a part thereof, respectively. The output signals of the transmission channels 111, 112 and 113 are coupled together by a coupling means 110.

The input signals to the coupling means 110, i.e. the output signals from the transmission channels 111, 112 and 113, are amplified by power amplifiers 131, 132 and 133 and converted into sounds by electro-acoustic transducers 141, 142 and 143 respectively, and thereby coupled with each other acoustically. The input signals of the coupling means 110 can also be electrically coupled together by resistors 151, 152 and 153 and amplified by a power amplifier 134 and radiated by the electro-acoustic transducer 144 and further coupled acoustically with the sounds from transducers 141, 142 and 143.

The electro-acoustic transducers 141, 142, 143 and 144 are preferably arranged so as to surround a listener or to produce a reflection of sounds.

The modulation means 122 and 123 are, for example, phase modulators for producing at least either a modulation in depth or a modulation in frequency which increases with an increase in the frequency of the input audio signal. Two examples of the modulation depth vs. audio frequency characteristic are shown in FIG. 2. The dotted line (a) shows a continuous increase in the modulation depth with an increase in the frequency of the input audio signal. The solid line (b) shows a stepwise increase in the modulation depth with an increase in the frequency of the input audio signal. FIG. 3 shows two examples of the modulation frequency vs. frequency characteristic. The dotted line (c) shows a continuous increase and the solid line (d) shows a stepwise increase with an increase in the frequency of the signal.

The modulation frequencies of the modulation means 122 and 123 are sub-audio frequencies ranging from 0.5 Hz to 10 Hz. The modulation phases of said modulation means 122 and 123 are different from each other and can be different from each other by $2\pi$ radians divided by the number of said modulation means. When the number of said modulation means is 2, for example, the modulation phases are different from each other by $\pi$ radians.

FIG. 4 shows a second embodiment of an electronic expression device according to the present invention and explains one of the basic functions of the present invention. The audio frequency signal applied to the input terminal 100 is distributed to the modulation means 122 and 123 through distributing means 120 which connects the input terminal 100 directly with the modulation means 122 and 123. The output signals modulated by the modulation means 122 and 123 are coupled together by coupling means 110 which comprises a power amplifier 134, an electro-acoustic transducer 144 and resistors 152 and 153 for combining the output signals of the modulation means 122 and 123, respectively. The modulation means 122 and 123 are, for example, phase modulators for producing at least either a modulation in depth or a modulation in frequency which increases with an increase in the frequency of the input audio signal as shown in FIG. 2 or FIG. 3.

The modulation signals of the modulation means 122 and 123 have, for example, phases which are opposite to each other.

The audio frequency signal generally has many frequency components, and each component can be represented by a frequency vector on a vector diagram.

FIG. 5 is a vector diagram of an output signal $\dot{A}$ of the modulation means 122, an output signal $\dot{B}$ of the modulation means 123 and a signal $\dot{C}$, the vector of which at a maximum is double the combined signal combined in the resistors 152 and 153. In FIG. 5, the input signal at the input terminal 100 is shown by the vector $\overrightarrow{OI}$. The modulation means 122 converts the vector $\overrightarrow{OI}$ to a vector $\dot{A}$ which is shifted from the vector $\overrightarrow{OI}$ by a maximum of $\phi$ radians, and the modulation means 123 converts the vector $\overrightarrow{OI}$ to a vector $\dot{B}$ which is shifted from the vector $\overrightarrow{OI}$ by a maximum of $-\phi$ radians. Thus the vector $\dot{A}$ and the vector $\dot{B}$ are symmetrical with respect to the vector $\overrightarrow{OI}$. The sum of the vectors $\dot{A}$ and $\dot{B}$ is a vector $\dot{C}$.

When the maximum phase deviation produced by the modulation means 122 and 123 is $\phi$ radians at an input frequency $f$, the vectors $\dot{A}$ and $\dot{B}$ move symmetrically to each other between angle $-\phi$ and $+\phi$; the vector $\dot{C}$, which is the sum of the vectors $\dot{A}$ and $\dot{B}$, expands and contracts in length between $\overrightarrow{OC_1}$ and $\overrightarrow{OC_o}$. When said maximum phase deviation is between zero and $\pi/2$ radians, the length of the vector $\dot{C}$ changes between zero and $\overrightarrow{OC_o}$, and the frequency of the expansion and contraction is twice the modulation frequency of said modulation means 122 and 123. When said maximum phase deviation increases and is between $\pi/2$ and $\pi$ radians, the vector $\dot{C}$ expands and contracts between $C_4$ and $C_o$ as well as between $C_o$ and O, and the vector $\dot{C}$ expands and contracts four times during a modulation period. In general, when said maximum phase deviation is between $n\pi/2$ and $(n+1)\pi/2$ radians, where $n$ is zero or a positive integer, the frequency of the expression and contraction is $2(n+1)$ times as great as the modulation frequency. As said maximum phase deviation increases with an increase in the input frequency $f$, the modulation depth increases initially and then the frequency of modulation increases with an increase in the input frequency.

According to the operation mentioned above, the embodiment of the present invention shown in FIG. 4 converts the input audio frequency signal into a new signal having the characteristic that at least either the modulation depth or the modulation frequency increases with an increase in the frequency of the input audio signal.

Figure 6:
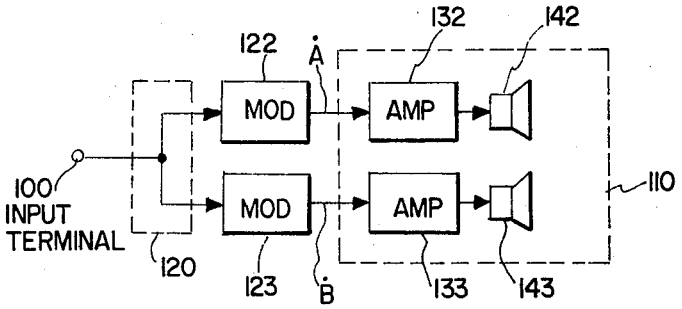
FIG. 6 is a schematic block diagram of a third embodiment of the device of the present invention.

FIG. 6 shows a third embodiment of the electronic expression device for producing a tremulant effect, which is a modified embodiment of the electronic expression device of the present invention. The audio frequency signal applied to the input terminal 100 is distributed to the modulation means 122 and 123 through the distributing means 120 which connects the input terminal 100 directly with the modulation means 122 and 123. The output signals $\dot{A}$ and $\dot{B}$ modulated by the modulation means 122 and 123 are coupled together by a coupling means 110 which comprises power amplifiers 132 and 133 and electro-acoustic transducers 142 and 143. Then modulated signals of the modulation means 122 and 123 have, for example, opposite phases.

The difference between the embodiments of FIG. 4 and FIG. 6 is in the method of coupling the output signals $\dot{A}$ and $\dot{B}$ of the modulation means 122 and 123. In FIG. 4, the signals $\dot{A}$ and $\dot{B}$ are coupled together electrically, but in FIG. 6 the signals $\dot{A}$ and $\dot{B}$ are coupled acoustically. When the position of a listener is equally distant from the electro-acoustic transducers 142 and 143, acoustic signals radiated from said transducers 142 and 143 are equally delayed in reaching the listener's position and then are coupled together. The amplitude of the coupled signal is a maximum at all the frequencies at the moment when the phase deviations of the modulation means 122 and 123 are zero radians; that is, when the acoustic signal has a plurality of vectors corresponding to the frequency spectra of said acoustic signal, all the vectors become maximum in the amplitude at the same time.

But when the listener's position is not equally distant from the electro-acoustic transducers 142 and 143, the acoustic signals travel from said transducers 142 and 143 to the listener's position in different lengths of time. Therefore, the phase difference between said acoustic signals at the listener's position increases in proportion to the frequency of the acoustic signals. Even when the phase deviation of the modulators 122 and 123 is zero radians, there is a phase difference which increases with an increase in the frequency of the acoustic signal and the amplitude of the coupled signal is not maximum in all the frequencies at the same time. Consequently, fluctuations of the vectors of the signal produced by the embodiment of FIG. 6 is more complex than that produced by the embodiment of FIG. 4 and more complex than the fluctuations of the vectors of the signal at a listener's position which is equally distant from the electro-acoustic transducers 142 and 143 in the embodiment of FIG. 6.

The modulated signals produced by the modulation means 122 and 123 do not need to have exactly opposite phases.

Figure 7:
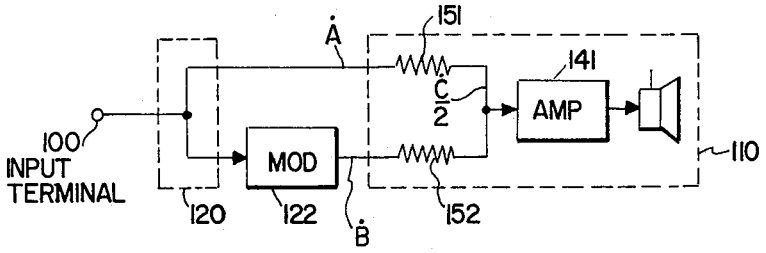
FIG. 7 is a schematic diagram of a fourth embodiment of the device of the present invention for producing a beat-like effect.

FIG. 7 shows a fourth embodiment of an electronic expression device for producing a tremulant effect according to the present invention and explains another basic function of the present invention. The audio frequency signal applied to the input terminal 100 is fed to the modulation means 122 and to one input terminal of the coupling means 110 through the distributing means 120 which connects the input terminal 100 with the modulation means 122 and one input terminal of the coupling means 110. The output signal of the distributing means 120 and the output signal of the modulation means 122 are coupled together by the coupling means 110 which comprises resistors 151 and 152 combining the input signals, a power amplifier 134 and the electro-acoustic transducer 144. The modulation means 122 is, for example, a phase modulator and at least either the modulation depth or the modulation frequency of the modulator increase with an increase in the frequency of the input audio signal according to the characteristic as shown in FIG. 2 or FIG. 3.

FIG. 8 shows a vector diagram of input signals $\dot{A}$ and $\dot{B}$ of the coupling means 110 and a signal C, which vector is the combined signal coupled through the resistors 152 and 153. The input signal applied to the input terminal 100 is essentially the same as the signal $\dot{A}$ and also is essentially the same as the input signal to the modulation means 122 in FIG. 7. The modulation means 122 converts the vector $\dot{A}$ into a vector $\dot{B}$ which is shifted from the vector $\dot{A}$ by $\phi$ radian. A vector $\dot{C}$, i.e. a sum of the vectors $\dot{A}$ and $\dot{B}$, moves on a circular locus OCCo in accordance with the rotation of the vector $\dot{B}$ on a circle with a center O and a radius $\overrightarrow{OA}$. As the angle of vector $\dot{B}$ fluctuates between $\phi$ radian and $-\phi$ radian, the vector $\dot{C}$ moves between C and C'. As a result, the motion of the vector $\dot{C}$ resembles the beat, and the tonal quality of the sound represented by the vector $\dot{C}$ has a strength and clearness similar to the beat. Because the maximum phase deviation of the modulation means 122 increases with an increase in the input frequency and the vector $\dot{B}$ travels faster on the circle having the center O with an increase in the frequency of the input signal. The fluctuation of the vector $\dot{C}$ also increases initially in depth and then in frequency with an increase in the input frequency.

Figure 9:
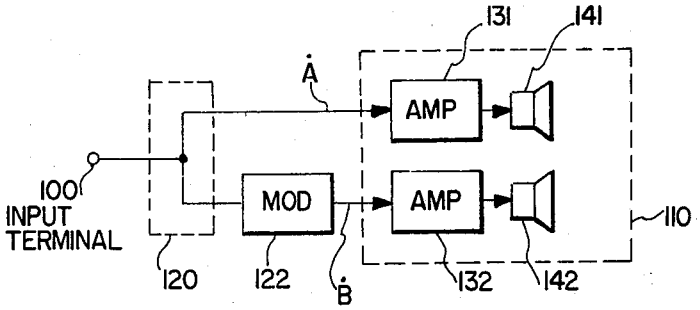
FIG. 9 is a schematic block diagram of a fifth embodiment of the device of the present invention.

When the coupling means 110, as shown in FIG. 6, is used instead of the coupling means 110 in FIG. 7, as shown in FIG. 9, the vector $\dot{C}$ does not become a maximum at the moment when the phase deviation $\phi$ is zero radians at a listener's position which is equally distant from the electro-acoustic transducers 141 and 142. Consequently, a more complex fluctuation of the audio frequency signal is produced.

Figure 10:
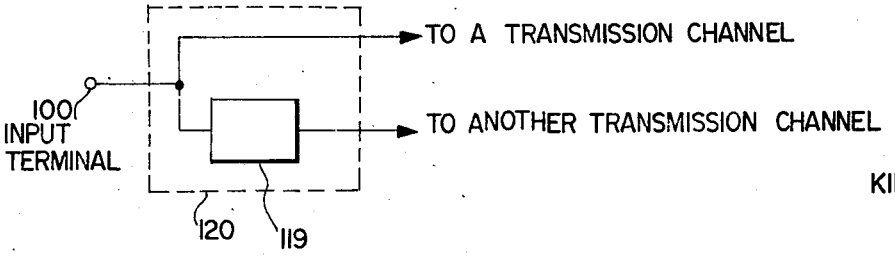
FIG. 10 is a schematic block diagram of an embodiment of the distributing means which is used in the device of the present invention for processing music electronically.

When one output signal of the distributor 120 in FIG. 4, FIG. 6, FIG. 7 or FIG. 9 is delayed by a delay network or a phase shifting circuit, the above-mentioned maximizing of the vector $\dot{C}$ does not occur even at the moment when the phase deviation of the modulation means 122 and 123 is zero radians. FIG. 10 shows the example of an embodiment of the distributing means 120 which is a distributing circuit containing a delay network 119. The input audio frequency signal applied to the input terminal 100 is converted into two signals, the phases of which are different from each other by an increasing amount with an increase in the frequency of the input signal. Said two signals are fed to the respective channels as shown in FIG. 10. The delay network 119 can be a delay line, a phase shifting circuit or any phase shifter which shifts the phase of the signal in accordance with the frequency of the signal. Therefore the distributing means 120, shown in FIG. 10, can be called a distributing means of the phase splitter type.

When the phase shift characteristics of the modulation means 122 in FIG. 4 or FIG. 6 is different from that of the modulation means 123, the above-mentioned maximizing does not occur.

When the modulation means 122 shown in FIG. 7 has a characteristic such that the phase angle increases with the frequency, the maximizing also does not occur.

At least one of said channels 111, 122 and 123 shown in FIG. 1 can further comprise a delay network 119 which is, for example, shown in FIG. 10 and can have a characteristic such that the phase shift characteristics of said channels are different from each other so that the maximizing does not occur.

The embodiment of FIG. 1 can produce a signal having more complex fluctuations of the vectors when combined with the embodiments of FIG. 4, FIG. 6, FIG. 7 and FIG. 9.

The modulation means 122 and 123 can be amplitude modulators which have at least either the modulation depth characteristic shown in FIG. 2 or the modulation frequency characteristic shown in FIG. 3.

When some output signals of the distributing means 120 are restricted to one or more frequency ranges, the spatial distribution of the sound can be made different according to the frequency of the signal so that a more complex effect is produced.

The following is a description of modulation means applicable to an electronic expression device for producing a tremulant effect. The modulation depth of a conventional modulator has been limited to the range between 0 to 100% for amplitude modulation and between $-\pi/4$ radians to $\pi/4$ radians for phase modulation and the modulation depth has been constant regardless of the frequency of the signal which is to be modulated.

When the amplitude modulation depth exceeds 100%, or when the phase modulation depth exceeds $\pm \pi/2$ radians, a more complex effect is produced as mentioned above.

A first example of modulation means usable in a system for processing music electronically is as follows.

Figure 11:
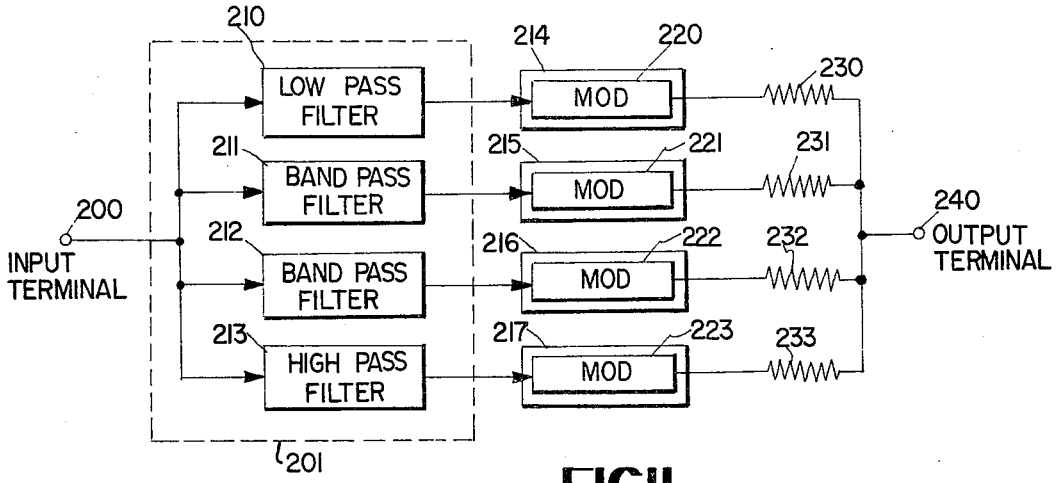
FIG. 11 is a schematic block diagram of an embodiment of the modulation means which is used in the device of the present invention for processing music electronically.

With reference to FIG. 11, the audio frequency signal applied to an input terminal 200 is separated into a plurality of sub-bands of audio frequency by a frequency range separator 201 comprising, for example, a low pass filter 210, band pass filters 211 and 212 and a high pass filter 213. The low pass filter 210 passes the components of the signal, the frequency of which is, for example, higher than 20Hz and lower than $f_1$ Hz; the band pass filter 211 passes the components of the signal, the frequency of which is higher than $f_1$ Hz and lower than $f_2$ Hz; the band pass filter 212 passes the components of the signal, the frequency of which is higher than $f_2$ Hz and lower than $f_3$ Hz; and the high pass filter 213 passes the components of the signal, the frequency of which is higher than $f_3$ Hz. The frequencies $f_1$, $f_2$ and $f_3$ have a relation 20 Hz $< f_1 < f_2 < f_3 <$ 20 KHz. The frequencies $f_1$, $f_2$, and $f_3$ are preferably, for example, about 255Hz, 510Hz and 102Hz, respectively. The separated signals are fed to a plurality of respective sub-channels 214, 215, 216 and 217 which have, for example, phase modulators 220, 221, 222 and 223, respectively, and the output signals from the said sub-channels 214, 215, 216 and 217 are combined through resistors 230, 231, 232 and 233 at an output terminal 240. Phase modulators 220, 221, 222 and 223 can be conventional phase modulators, the modulation depth of which is constant regardless of the frequency of the input signal.

Figure 12:
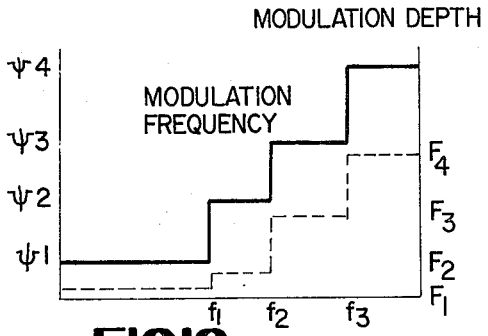
FIG. 12 is a diagram of the modulation depth and modulation frquency vs. input signal frequency characteristics of the modulation means of FIG. 10.

When modulation frequencies $F_1$, $F_2$, $F_3$ and $F_4$ of the modulators 220, 221, 222 and 223, respectively, have a relation $F_1 \leqq F_2 \leqq F_3 \leqq F_4$, and all are in a sub-audio frequency range, and when the maximum phase deviations of the modulators 220, 221, 222 and 223 are $\Psi_1$, $\Psi_2$, $\Psi_3$ and $\Psi_4$, respectively, and further have a relationship $\Psi_1 = \Psi_2 = \Psi_3 = \Psi_4$, the embodiment of the modulation means has, in total modulation depth and modulation frequency, characteristics such as those shown in FIG. 12.

Said frequency range separator 201 can comprise a low pass filter 210 and a high pass filter 213 or can comprise a low pass filter, one or more band pass filters and a high pass filter.

Some of said sub-channels can be replaced by leads directly connecting the filters with the respective resistors 230, 231, 232 and 233.

The modulation frequencies $F_1$, $F_2$, $F_3$ and $F_4$ can be equal to each other. The maximum phase deviations $\Psi_1$, $\Psi_2$, $\Psi_3$ or $\Psi_4$ can also be equal to each other.

The modulation frequencies $F_1$, $F_2$, $F_3$ and $F_4$ can have a harmonic relation, for example, $$F_2 = 2F_1,\ F_3 = 3F_1,\ F_4 = 4F_1.$$

The modulation frequencies $F_1$, $F_2$, $F_3$ and $F_4$ can be in a harmonic relation and in the same phase as each other.

The modulation frequencies $F_1$, $F_2$, $F_3$ and $F_4$ can also be in a nonharmonic relation.

Said filters 210, 211, 212 and 213 can be such as will pass respective one octave sub-bands. Said filters need not have a frequency characteristic with an infinitely sharp cut-off and can have some overlaps of the sub-bands in order to change smoothly from one sub-band to the next.

In the above-mentioned description of an example of the embodiment of the modulation means, amplitude modulators can be used instead of the phase modulators 220, 221, 222 and 223.

The same functions mentioned above are obtained by reversing the order of the connection between the frequency range separator 210 and the sub-channels 214, 215, 216 or 217.

When the distributing means 120 of FIG. 1 is connected directly between the input terminal 100 and the channels 111, 112 or 113, and a plurality of the modulation means as shown in FIG. 11 is used in the system for processing music electronically, one frequency range separator is enough to separate the audio frequency signal into a plurality of sub-bands. Therefore, a plurality of the frequency range separators can be combined into one.

It is more effective to use modulators that have more modulation depth than conventional modulators. Examples of such modulators are described below.

Figure 13:
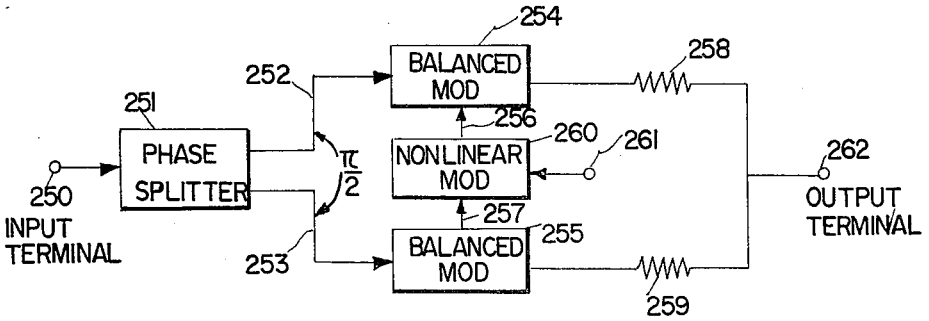
FIG. 13 is a schematic block diagram of an embodiment of a phase modulator which can modulate more than $\pm \pi/4$ radians.
Figure 14:
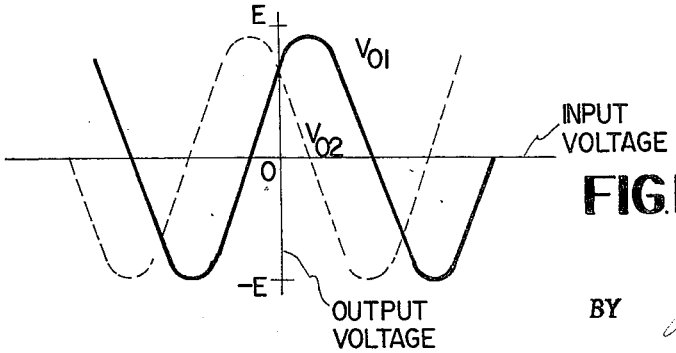
FIG. 14 is a diagram of the output vs. input characteristic of a nonlinear circuit which is used in the embodiment of the phase modulator shown in FIG. 13.

FIG. 13 shows one embodiment of a phase modulator which can modulate the signal by a phase more than $\pm \pi/4$ radian. Referring to FIG. 13, the signal applied to the input terminal 250 is converted into two converted signals supplied to leads 252 and 253 by a phase splitter 251. The phase splitter 251 splits the signal at the terminal 250 into two signals having a phase difference of $\pi/2$ radians from each other. Said two converted signals differ in phase difference of $\pi/2$ radians. The converted signals are fed to a pair of balanced modulators 254 and 255 through said pair of leads 252 and 253 respectively. A pair of the output signals from the balanced modulators 253 and 255 are coupled together at an output terminal 262 through resistors 258 and 259. A modulation signal is fed to the terminal 261 and converted into two modulation signals by a nonlinear circuit 260. The converted modulation signals are fed to the balanced modulators 254 and 255 through leads 256 and 257, respectively. FIG. 14 shows output vs. input characteristics of the nonlinear circuit 260. The output voltages $Vo_1$ and $Vo_2$ are represented as a function of the input voltage Vin as follows:

$$Vo_1 = E \sin\left(\frac{Vin}{V} + \frac{\pi}{4}\right)$$

$$Vo_2 = E \cos\left(\frac{Vin}{V} + \frac{\pi}{4}\right) \qquad (2)$$

where $E$ and $V$ are arbitrary constants.

Figure 15:
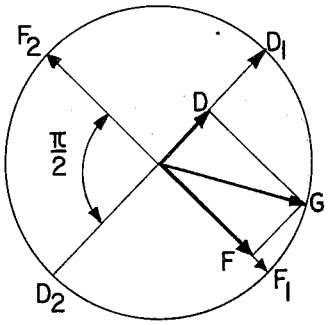
FIG. 15 is a vector diagram explaining the operation of the phase modulator of FIG. 13.

FIG. 15 is a vector diagram of the output signal of the balanced modulators 254 and 255 and the signal at the output terminal 262. A vector $\overrightarrow{OD}$ is the output signal of the balanced modulator 254 and fluctuates between $D_1$ and $D_2$ and can be represented as:

$$E \sin\left(\frac{Vin}{V} + \frac{\pi}{4}\right) \sin\left(2\pi f_c t + \frac{\pi}{4}\right) \qquad (3)$$

A vector $\overrightarrow{OF}$, i.e., the output signal of the balanced modulator 255, fluctuates between $F_1$ and $F_2$ and can be represented as $$E \cos\left(\frac{Vin}{V} + \frac{\pi}{4}\right) \sin\left(2\pi f_c t - \frac{\pi}{4}\right), \quad (4)$$

where $f_c$ is the frequency of the input signal at the input terminal 250.

The coupled signal at the output terminal 262 is a vector half the length of a vector $\overrightarrow{OG}$, and is represented as follows:

$$\tfrac{1}{2} E \sin\left(\frac{Vin}{V} + \frac{\pi}{4}\right) \sin\left(2\pi f_c t + \frac{\pi}{4}\right) + \tfrac{1}{2} E \cos\left(\frac{Vin}{V} + \frac{\pi}{4}\right)$$

$$\sin\left(2\pi f_c t - \frac{\pi}{4}\right) = \tfrac{1}{2} E \sin\left(2 f_c t + \frac{Vin}{V}\right). \quad (5)$$

Therefore, the vector $\overrightarrow{OG}/2$ is the vector of a phase modulated signal the modulation depth of which is determined by Vin/V.

Figure 16:
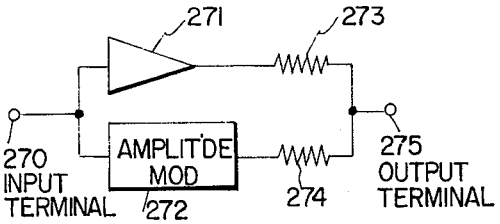
FIG. 16 is a schematic block diagram of an embodiment of an amplitude modulator which can overmodulate, i.e., which can modulate so that a modulation depth exceeds 100%.
Figure 17:
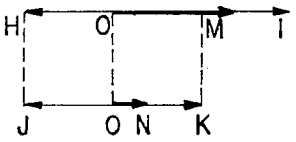
FIG. 17 is a vector diagram explaining the operation of the amplitude modulator of FIG. 16.

FIG. 16 shows an embodiment of an amplitude modulator which can modulate a signal with a modulation depth more than 100%. The signal applied to the input terminal 270 is fed to a conventional amplitude modulator 272 which can modulate the input signal up to 100% and to an inverter 271 which has a gain of unity. The modulated signal and the inverted signal are coupled together at the output terminal 275 through the resistors 273 and 274. With reference to FIG. 17, the amplitude modulated signal is represented by a vector $\overrightarrow{OM}$ which fluctuates between 0 and I and always in the same direction. The inverted signal is represented by a vector $\overrightarrow{OH}$. The sum of the vectors, summed vector $\overrightarrow{ON}$, fluctuates between J and K and changes the direction from $\overrightarrow{OH}$ to $\overrightarrow{OK}$ and from $\overrightarrow{OK}$ to $\overrightarrow{OJ}$. The vector $\overrightarrow{ON}$ represents double the deeply modulated signal at the output terminal 275. The gain of the inverter need not always be unity and can change with the frequency of the input signal.

A second embodiment of a modulation means for the system for processing music electronically has a construction in which the phase shift characteristic or the delay time of a delay network fluctuates.

Figure 18:
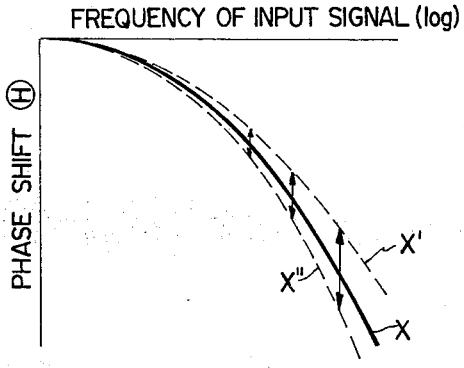
FIG. 18 is a diagram of the phase vs. frequency characteristic of another embodiment of the modulation means which is used in the device according to the present invention for processing music electronically.
Figure 19:
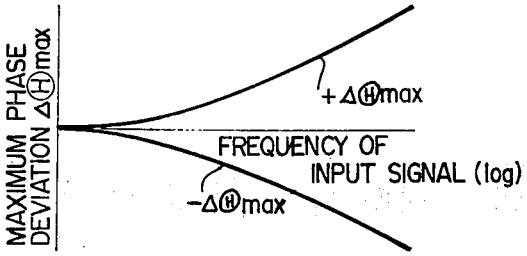
FIG. 19 is a diagram of the phase deviation vs. frequency characteristic of the modulation means for which the phase vs. frequency characteristic is shown in FIG. 18.

FIG. 18 shows an embodiment of a phase shift characteristic X of a delay network. The phase shift Ⓗ of FIG. 18 increases exponentially with a logarithmic increase of the frequency of the input signal. When the delay time of the delay network fluctuates, the phase shift characteristic fluctuates between X′ and X″ as shown in FIG. 18, and phase modulation occurs in such a manner that the maximum phase deviation $+\Delta Ⓗ_{max}$ and $-\Delta Ⓗ_{max}$ of said phase modulation increases with increasing frequency of the input signal as shown in FIG. 19.

Figure 20:
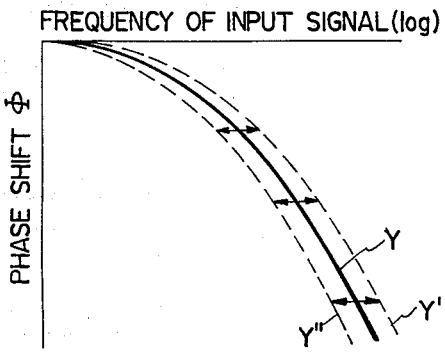
FIG. 20 is a diagram of the phase vs. frequency characteristic of a further example of the modulation means which is applicable to the device of the present invention for processing music electronically.
Figure 21:
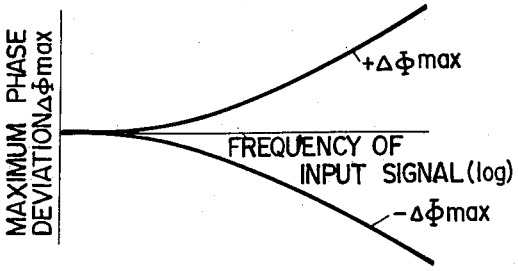
FIG. 21 is a diagram of the phase deviation vs. frequency characteristic of the modulation means for which the phase vs. frequency characteristic is shown in FIG. 20.

A third embodiment of a modulation means for the electronic expression device for producing a tremulant effect is one in which the phase shift characteristic of a phase shifter fluctuates. A curved line Y in FIG. 20 shows a phase shift characteristic in which the rate of the increment of the phase shift Φ increases with an increase in the frequency of the input signal. If the curved line Y fluctuates in a direction parallel to the frequency axis between a curved line Y′ and another curved line Y″, a phase deviation from the curved line Y occurs between the maximum phase deviation $+\Delta\Phi_{max}$ and $-\Delta\Phi_{max}$ as shown in FIG. 21. The phase deviation characteristic $\pm\Delta\Phi_{max}$ as shown in FIG. 21 is also usable in a system for processing music electronically. Such a modulation means is shown in FIG. 22.

Figure 22:
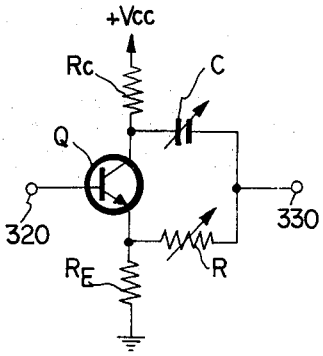
FIG. 22 is a circuit diagram of an example of a phase shifting circuit.

The phase shifting circuit of FIG. 22 comprises a resistor R, a capacitor C and a phase splitter which is composed of a transistor Q, and resistors $R_E$ and $R_C(=R_E)$. Said transistor Q splits the signal applied to an input terminal 320 into a pair of signals which are opposite in phase, and the pair of signals is coupled together through the resistor R and the capacitor C at the output terminal 330.

The transfer function G(s) of the phase shifting circuit shown in FIG. 22 is $$G(s) = \frac{1 - s}{1 + s}, \quad (6)$$

where $s$ is a complex angular frequency. The amplitude transfer characteristic of the equation (6), that is, the gain of the phase shifting circuit is constant regardless of the frequency, and the phase characteristic changes from zero to $-\pi$ radians as the frequency increases, as shown in the curved line Z of FIG. 23.

The phase of the signal is shifted by $-\pi/2$ radians at a center frequency $f_o = \tfrac{1}{2}\pi RC$. The center frequency $f_o$ and the phase shifting characteristic changes with variations in the resistance of the resistor R, the capacitance of the capacitor C, or both the resistance of the resistor R and the capacitance of the capacitor C. By connecting a plurality of the phase shifting circuits in cascade and equalizing each center frequency of the phase shifting circuits, a total phase shifting characteristic in the shape of the curved line Z′ of FIG. 23 can be obtained. By setting the center frequency $f_o$ to a value near the highest frequency of the audio frequency range and causing the center frequency $f_o$ to fluctuate by changing the resistance of the resistor R, the capacitance of the capacitor C, or both the resistance of the resistor R and the capacitance of the capacitor C, a phase shifting characteristic as shown in FIG. 20 and a phase deviation characteristic as shown in FIG. 21 can be obtained.

Figure 24:
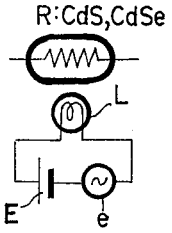
FIG. 24 is a circuit diagram of an example of a variable resistor.

FIG. 24 shows an example of means for causing the resistance of the resistor R to fluctuate. The resistor R is, for example, a photo-sensitive resistor such as a CdS or a CdSe element exposed to the light of a lamp L which is lighted not only by a D.C. power supply E for biasing the value of the resistor R to some central value, but also by an A.C. modulating signal $e$ which causes the value of the resistor R to fluctuate from said central value.

The transistor Q can be replaced by a vacuum tube, a field effect transistor or a transformer. The phase splitter can be composed of a transformer. The resistor R can be replaced by any variable resistor such as a Hall effect element. The capacitor C can be replaced by any reactor such as an inductor.

Figure 25:
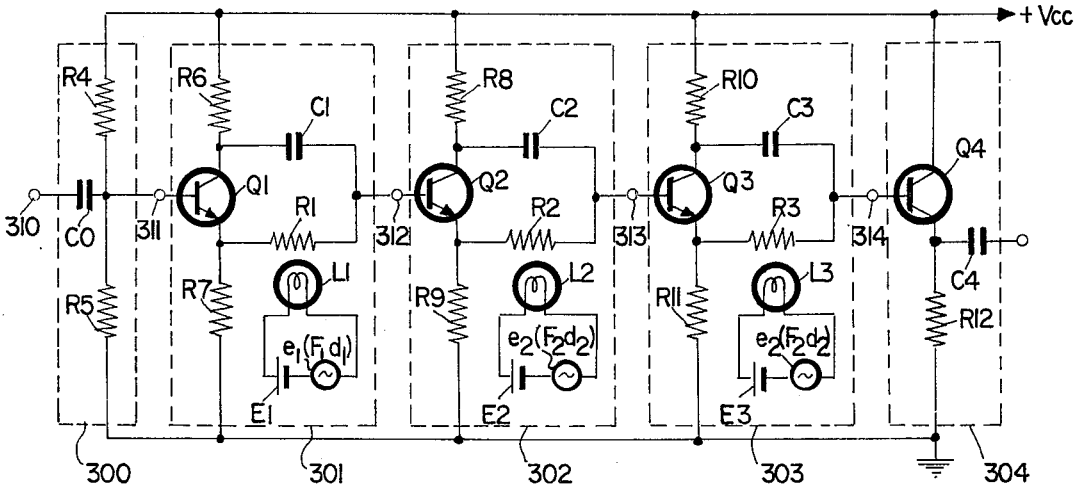
FIG. 25 is a schematic block diagram of an embodiment of a modulation means comprising the phase shifting circuits shown in FIG. 22.

FIG. 25 shows an example of a modulation means which comprises three phase shifting circuits 301, 302 and 303, a biasing circuit 300 and an emitter follower circuit 304 in cascade connection. An audio frequency signal applied to an input terminal 310 is fed, through a coupling condenser $C_o$ and a terminal 311, to the base of the transistor $Q_1$, which is biased by resistors $R_4$ and $R_5$, and appears at an output terminal 312. The signal at the terminal 312 is fed through a similar phase shifting circuit 302 to the terminal 313 and then through another similar phase shifting circuit 303 to the terminal 314. It is then fed to the high impedance input terminal 314 of an emitter follower circuit 304 and finally appears at the low impedance output terminal 315.

The resistors $R_1$, $R_2$ and $R_3$ of the phase shifting circuits 301, 302 and 303, respectively, are photo-sensitive resistors such as a CdS or a CdSe element exposed to the light of the lamps $L_1$, $L_2$ and $L_3$, respectively, which in turn are lighted by D.C. power supplied $E_1$, $E_2$ and $E_3$ biasing each of the resistors $R_1$, $R_2$ and $R_3$, respectively, at some central values and which are further lighted by A.C. modulated power supplies $e_1$, $e_2$ and $e_3$ in order to cause the resistances of the resistors $R_1$, $R_2$ and $R_3$ to fluctuate at frequencies $F_1$, $F_2$ and $F_3$ and phases $\alpha_1$, $\alpha_2$ and $\alpha_3$, respectively, from the central values.

Figure 23:
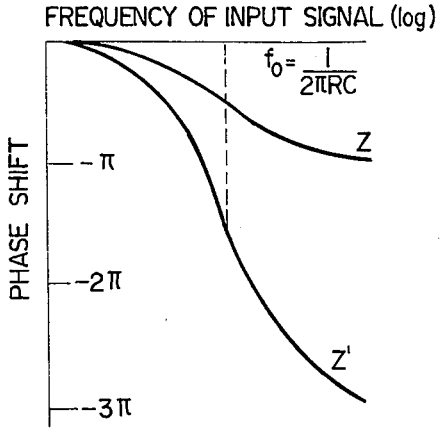
FIG. 23 is a diagram of the phase characteristic of the circuit shown in FIG. 22 and the phase characteristic of a further embodiment of the modulation means.

The phase shifting circuits 301, 302 and 303 have, for example, a phase shifting characteristic according to the curved line Z as shown in FIG. 23 and have center frequencies $1/2\pi R_1C_1$, $1/2\pi R_2C_2$ and $1/2\pi R_3C_3$, respectively.

Figure 26:
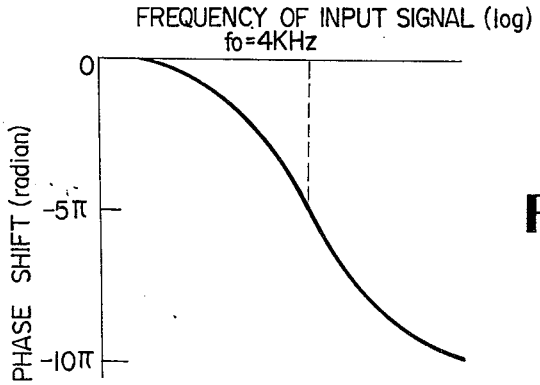
FIG. 26 is a diagram of an example of a preferred phase characteristic of an embodiment of the modulation means.
Figure 27:
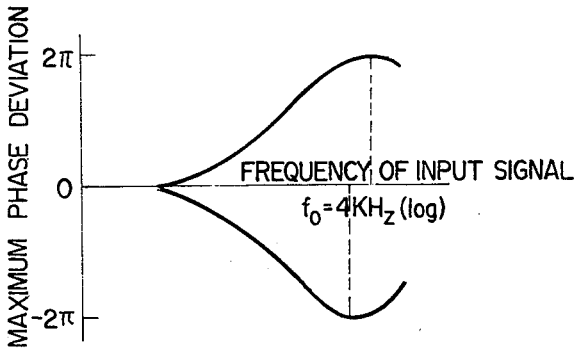
FIG. 27 is a diagram of an example of a preferred phase deviation characteristic of an embodiment of a modulation means.

If said three center frequencies are equal, that is, $$f_o = 1/(2\pi R_1C_1) = 1/(2\pi R_2C_2) = 1/(2\pi R_3C_3), \quad (7)$$

the total phase shift characteristic vs. frequency becomes a curved line Z′ shown in FIG. 23. By setting the center frequency $f_o$ near the highest frequency of the audio frequency range and further setting the A.C. modulating power supplies $e_1$, $e_2$ and $e_3$ at the same frequency and the same phase, the modulation means shown in FIG. 25 has a phase shifting characteristic and fluctuation characteristic as shown in FIG. 20, and the phase deviation characteristic as shown in FIG. 21. The number of phase shifting circuits connected in cascade can be more than three, and preferably is 10. Preferred examples of the phase shifting characteristics and the phase deviation characteristics are shown in FIG 26 and FIG. 27, respectively, where the maximum phase deviation exceeds $\pm \pi/2$ radians and reaches $\pm 2\pi$ radians.

Figure 28:
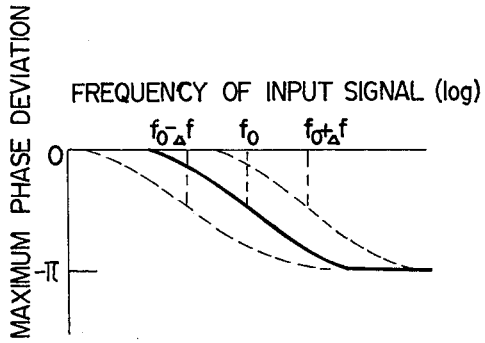
FIG. 28 is a diagram of the phase characteristic of the phase shifting circuit shown in FIG. 22.
Figure 29:
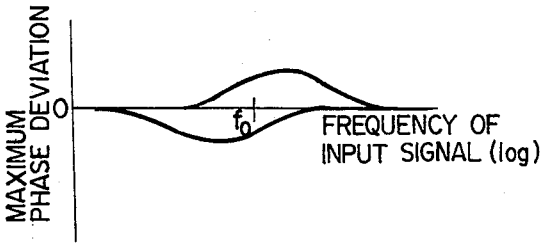
FIG. 29 is a diagram of the phase deviation characteristic of the phase shifting circuit shown in FIG. 22.
Figure 30:
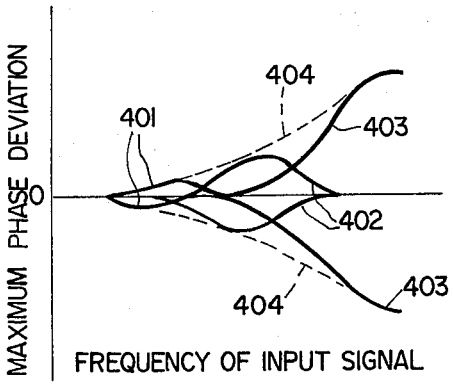
FIG. 30 is a diagram of an example of the phase deviation characteristic of a modulation means.

A fourth embodiment of a modulation means will now be described. The phase shifting circuit shown in FIG. 22, for example, has a phase shifting characteristic fluctuating in a direction parallel to the frequency axis in accordance with the fluctuation of the center frequency $f_o(=1/(2\pi RC))$ as shown in FIG. 28, and has a maximum phase deviation characteristic restricted in some frequency band as shown in FIG. 29. When $1/(2\pi R_1C_1)$, $1/(2\pi R_2C_2)$, $1/(2\pi R_3C_3)$, $e_1$, $e_2$, $e_3$, $F_1$, $F_2$, $F_3$, $\alpha_1$ $\alpha_2$ and $\alpha_3$ of the phase shifting circuits 301, 302 and 303 shown in FIG. 25 are related to each other in the following manner:

$$1/(2\pi R_1C_1) < 1/(2\pi R_2C_2) < 1/(2\pi R_3C_3) \quad (8)$$

$$e_1 < e_2 < e_3 \quad (9)$$

$$F_1 = F_2 = F_3 \quad (10)$$

$$\alpha_1 = \alpha_2 = \alpha_3, \quad (11)$$

the maximum phase deviation of the phase shifting circuits 301, 302 and 303 are shown by the curved lines 401, 402 and 403 and the total maximum phase deviation is shown by dotted curves 404 in FIG. 30. Though the phase deviation achieved by one phase shifting circuit is not more than $\pm \pi/2$ radians, a greater phase deviation can be achieved by cascading a plurality of phase shifting circuits which have the same characteristics as each other. Therefore, any phase deviation characteristic can be achieved by using more than three phase shifting circuits and by having the center frequencies and amounts of the phase deviation in a suitable relation as described above.

Figure 31:
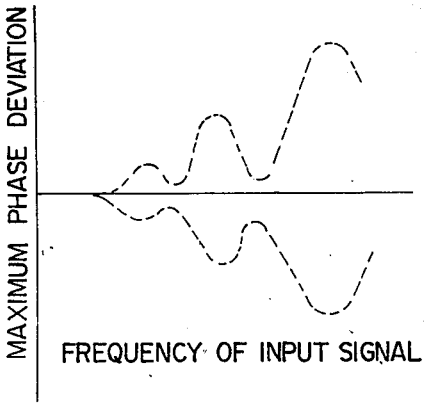
FIG. 31 is a diagram of another example of the phase deviation characteristic of a modulation means.

By keeping the frequencies $F_1$, $F_2$ and $F_3$ at the same frequencies as in equation (10) and changing the phases $\alpha_1$, $\alpha_2$ and $\alpha_3$ to $$\alpha_1 \neq \alpha_2, \alpha_2 \neq \alpha_3, \alpha_3 \neq \alpha_1, \quad (12)$$

the maximum phase deviation decreases in the overlapping range between 402 and 401 or 403 in FIG. 30. As a result, the undulations in the maximum phase deviation increase with the increase of the frequency of the input signal applied to the input terminal 310 as shown in FIG. 31.

When the sub-audio modulation frequencies $F_1$, $F_2$ and $F_3$ are in the relationship $$F_1 < F_2 < F_3, \quad (13)$$

the modulation frequency of the modulation means shown in FIG. 25 increases with increasing frequency of the input signal applied to the input terminal 310.

In the relationship (13), the frequencies $F_1$, $F_2$ and $F_3$ can be in a harmonic relationship, and further can have the same phase as each other.

In the relationship (13), the frequencies $F_1$, $F_2$ and $F_3$ can also be in a non-harmonic relationship.

A number of phase shifting circuits greater than 3 can be used for more complex effects.

The modulation means mentioned with reference to FIGS. 18–31 can be used instead of the modulators 220, 221, 222 and 223 of FIG. 11.

The electronic expression device for producing a tremulant effect can be made by using modulation means which are phase shifting circuits other than that of FIG. 22.

The same effects mentioned above can be obtained by mechanical methods to change the delay time, the resistance of the resistor or the reactance of the reactor.

The modulation means and the modulators mentioned above can be frequency modulators because frequency modulation is similar to phase modulation.

The order of the connection among the distributing means, the frequency range separators and the modulators should not be construed as limiting the scope of the present invention. The present invention can be embodied in an electronic expression device for producing a tremulant effect in which at least one of a plurality of channels has the modulation increasing at least either the depth, the modulation frequency or both the depth and the modulation frequency with an increase in the frequency of the audio signal, and said channels preferably have different phase shift characteristics from each other and the output signals of said channels are coupled.

What is claimed is:

1. An electronic expression device for producing a tremulant effect comprising:

an input terminal to which an audio frequency signal is applied;

a distributing means;

a connecting means which connects said input terminal with said distributing means;

a plurality of transmission channels at least one of which has a modulation means therein for modulating the input signal of said transmission channels by a modulation signal, the frequency of which is in a sub-audio frequency range, and for modulating the input signal of said at least one of said plurality of transmission channels with a modulation depth increasing as the frequency of said audio frequency signal increases and exceeding $\pm \pi/2$ radians, said modulation means being a phase shifter having a constant amplitude gain and a phase shift the rate of the increment of which increases with an increase in the frequency, said phase shift fluctuating in said sub-audio modulation frequency range for producing a phase modulation having a maximum phase deviation which increases with an increase in the frequency of the signal of said channels at least until it exceeds $\pm \pi/2$ radians in the frequency range of said audio frequency signal;

a plurality of connecting means which connect said distributing means with said transmission channels; and a coupling means coupled to said transmission channels for coupling output signals of said plurality of transmission channels with each other, whereby said distributing means distributes said audio frequency signal to said plurality of transmission channels, said modulation means modulates by said modulation signal, at least one of the plurality of transmission channels puts out an output signal which is modulated differently from one other output signals of said plurality of transmission channels due to the modulation of said modulation means, and said coupling means couples the output signals from said plurality of transmission channels together in order to produce a final output signal, each vector of which fluctuates differently from the other vectors thereof and the pass-bands of at least two of said plurality of transmission channels coincide with each other at least partially.

2. An electronic expression device as claimed in claim 1 wherein said phase shifter is a delaying network having a delay time which fluctuates with a frequency similar to said sub-audio modulation frequency.

3. An electronic expression device as claimed in claim 1 wherein said phase shifter comprises a plurality of phase shifting circuits connected in cascade, each of said phase shifting circuits having a constant amplitude gain and a phase shift which changes gradually from zero radians to $-\pi$ radians with an increase in the frequency of said audio signal, the total amount of phase shift of a plurality of said phase shifter fluctuating at said sub-audio modulation frequency so that the phase deviation of said phase shifter increases with an increase in the frequency of said audio frequency signal.

4. An electronic expression device as claimed in claim 3 wherein said phase shifting circuit comprises a phase splitter which splits the input signal of said phase splitting means into two signals having phases opposite each other, and a coupling circuit which comprises a resistor and a reactor and combines said two signals into one output signal, and the product of the resistance of said resistor and the reactance of said reactor fluctuating at the frequency of said sub-audio modulation frequency.

5. An electronic expression device as claimed in claim 4 wherein said phase shifting circuit comprises a phase splitting circuit which has an input terminal and a pair of output terminals for splitting said audio frequency signal applied to said input terminal into a pair of signals having opposite phases at said pair of output terminals respectively, a further output terminal, a resistor connected between one of said pair of the output terminals and said further output terminal, a reactor connected between the other of said pair of the output terminals and said further output terminal, and the product of the resistance of said resistor and the reactance of said reactor fluctuating at the frequency of said sub-audio modulation frequency.

6. An electronic expression device as claimed in claim 5 wherein said resistor is a photo sensitive resistor and the resistance of which fluctuates at the same frequency as said sub-audio modulation frequency in response to light source having a fluctuation of light intensity.

7. An electronic expression device for producing a tremulant effct comprising:

an input terminal to which an audio frequency signal is applied;

a distributing circuit for converting said audio frequency signal into a plurality of signals having the same vector frequencies as those of said audio frequency signal and having a different phase from each other and having vectors which have amplitudes similar to said audio frequency signal and are increasingly different in phase from each other with an increase in the frequency of said audio frequency signal, a connecting means which connects said input terminal with said distributing means;

a plurality of transmission channels at least one of which has a modulation means therein for modulating the input signal of said transmission channels by a modulation signal, the frequency of which is in a sub-audio frequency range, and for modulating the input signal of said at least one of said plurality of transmission channels with a modulation depth increasing as the frequency of said audio frequency signal increases and exceeding $\pm \pi/2$ radians when the modulation is phase modulation and exceeding 100% when the modulation is amplitude modulation in the frequency range of said audio frequency signal;

a plurality of connecting means which connect said distributing means with said transmission channels; and a coupling means coupled to said transmission channels for coupling output signals of said plurality of transmission channels with each other, whereby said distributing means distributes said audio frequency signal to said plurality of transmission channels, said modulating means modulates by said modulation signal, at least one of the plurality of transmission channels puts out an output signal which is modulated differently from other output signals of said plurality of transmission channels due to the modulation of said modulation means, and said coupling means couples the output signals from said plurality of transmission channels together in order to produce a final output signal, each vector of which fluctuates differently from the other vectors thereof and the pass-bands of at least two of said plurality of transmission channels coincide with each other at least partially.

8. An electronic expression device for producing a tremulant effect, comprising;

an input terminal to which an audio frequency signal is applied;

a distributing means of the phase splitter type composed of means for converting said audio frequency signal into a plurality of signals having vectors which have amplitudes similar to said audio frequency signal and phases increasingly different from each other with an increase in the frequency of said audio frequency signal;

a connecting means which connects said input terminal with said distributing means of the phase splitter type;

a plurality of transmission channels, at least one of which has an amplitude modulation means therein for modulating the input signal of said transmission channels by a modulation signal, the frequency of which is in a sub-audio frequency range, and for modulating the input signal of said at least one of said plurality of transmission channels with an amplitude modulation depth increasing as the frequency of said audio frequency signal increases and the pass-bands of at least two of said plurality of transmission channels at least partially coincide with each other;

a plurality of connecting means which connect said distributing means of the phase splitter type with said transmission channels; and a coupling means coupled to said transmission channels for coupling output signals of said plurality of transmission channels with each other, whereby said distributing means distributes said plurality of signals to said plurality of transmission channels, said amplitude modulation means modulates by said modulation signal, at least one of a plurality of transmission channels puts out an output signal which is modulated differently from other output signals of said plurality of transmission channels due to said modulation means, and said coupling means couples the output signals from said plurality of transmission channels together in order to produce a final output signal, each vector of which fluctuates differently from the other vectors thereof.

* * * * *